US006823849B2

(12) United States Patent
Ichinose et al.

(10) Patent No.: US 6,823,849 B2
(45) Date of Patent: Nov. 30, 2004

(54) FUEL INJECTION SYSTEM AND CONTROL METHOD FOR INTERNAL COMBUSTION ENGINE STARTING TIME

(75) Inventors: Hiroki Ichinose, Fujinomiya (JP); Yuuichi Katou, Susono (JP); Masahiro Ozawa, Toshima-ku (JP); Nao Murase, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/623,618

(22) Filed: Jul. 22, 2003

(65) Prior Publication Data

US 2004/0107947 A1 Jun. 10, 2004

(30) Foreign Application Priority Data

Aug. 1, 2002 (JP) ..... 2002-225171

(51) Int. Cl.[7] ..... F02M 51/00
(52) U.S. Cl. ..... 123/491; 123/445; 123/179.18
(58) Field of Search ..... 123/491, 445, 123/179.16, 179.18, 179.3

(56) References Cited

U.S. PATENT DOCUMENTS

| | | | | | |
|---|---|---|---|---|---|
| 5,595,162 | A | * | 1/1997 | Iwai | 123/491 |
| 5,758,308 | A | * | 5/1998 | Maki et al. | 701/104 |
| 5,836,288 | A | | 11/1998 | Nakagawa | |
| 6,253,145 | B1 | * | 6/2001 | Garrard et al. | 701/105 |

FOREIGN PATENT DOCUMENTS

| | | |
|---|---|---|
| JP | A 5-214987 | 8/1993 |
| JP | A 11-173188 | 6/1999 |

* cited by examiner

*Primary Examiner*—John T. Kwon
(74) *Attorney, Agent, or Firm*—Oliff & Berridge PLC

(57) ABSTRACT

In an internal combustion engine including a plurality of cylinders, a fuel injection system and method sets an amount of fuel injected into each cylinder sequentially in a first cycle of fuel injection during a normal engine start in which an engine speed increases, such that an amount of fuel to be injected into one of the cylinders where the last injection is to be performed within the first cycle is larger than an amount of fuel to be injected into another one of the cylinders in the first injection within the first cycle.

37 Claims, 10 Drawing Sheets

FUEL INJECTION SYSTEM AND CONTROL METHOD FOR INTERNAL COMBUSTION ENGINE STARTING TIME

The disclosure of Japanese Patent Application No. 2002-225171 filed on Aug. 1, 2002, including the specification, drawings and abstract is incorporated herein by reference in its entirety.

BACKGROUND OF THE INVENTION

1. Field of the Invention

The invention relates to a fuel injection system for an internal combustion engine starting time and a control method of same.

2. Description of Related Art

When an internal combustion engine (hereinafter simply referred to as "engine" where appropriate) is started and the engine speed subsequently increases, the intake amount which is supplied into engine cylinders decreases and the negative pressure in each of the engine cylinders increases. Namely, as the engine speed increases, the intake amount supplied into the engine cylinders decreases. In view of this, there are known technologies, such as disclosed in Japanese Patent Laid-Open Publication No. 1-173188, in which a fuel injection control is performed so as to reduce the amount of fuel to be injected (hereinafter, referred to as a "fuel injection amount" where appropriate) with an increase in the engine speed during engine start.

Not only after the completion of warming-up but also during engine start, when an air-fuel ratio in the engine cylinder is rich, a large amount of unburned HC is generated. When the air-fuel ratio is too lean, conversely, combustion flames do not sufficiently spread, which may also result in the generation of a large amount of unburned HC. Namely, it is necessary to maintain the air-fuel ratio at the stoichiometric air-fuel ratio or at a slightly lean air-fuel ratio so as to suppress the generation of unburned HC.

Meanwhile, if the engine is of a type which directly injects fuel into the cylinder, when fuel is injected during engine start, a large amount of the injected fuel adheres, in liquid form, to a top face of a piston or an inner surface of a cylinder. Also, if the engine is of a type which injects fuel into intake ports, a large amount of the injected fuel adheres, in liquid form, to the inner surface of each intake port. Thus, in either type of internal combustion engine, air-fuel mixtures are formed by only a small part of injected fuel. The fuel adhered on the top face of the piston or on the inner surface of the intake port gradually evaporates to form air-fuel mixtures until the piston reaches a top dead center for compression. This air-fuel mixture accounts for a sizable proportion of the entire air-fuel mixture formed in the engine cylinder. Accordingly, in the aforementioned case, the air fuel ratio of the air-fuel mixture formed in the engine cylinder largely depends on the amount of the fuel evaporated from the inner surface.

The amount of the fuel which evaporates from the inner surface is proportional to the length of time until the piston reaches the vicinity of the top dead center for compression. The shorter this length of time becomes, a smaller amount of the fuel evaporates from the inner surface. Meanwhile, the length of time until the piston reaches the vicinity of the top dead center for compression is inversely proportional to the engine speed. Accordingly, as the engine speed increases, the air-fuel ratio of the air-fuel mixture increases.

As mentioned above, it is necessary to maintain the air-fuel ratio at the stoichiometric air-fuel ratio or at a slightly lean air-fuel ratio in order to suppress the generation of unburned HC. However, as mentioned above, as the engine speed increases, the air-fuel ratio of the air-fuel mixture increases. Accordingly, it is necessary to increase the fuel injection amount as the engine speed increases in order to maintain the air-fuel ratio at the stoichiometric air-fuel ratio or at a slightly lean air-fuel ratio while the engine speed is increasing during engine start. At this time, for suppressing the generation of unburned HC, it is necessary to prevent the air-fuel ratio from being temporarily rich or excessively lean.

As described earlier, in the conventional fuel injection control, when the engine speed is increasing during engine start, the fuel injection amount is reduced. When the fuel injection amount is thus reduced with the increase in the engine speed, the air-fuel ratio gradually increases while largely fluctuating. Therefore, when the engine speed starts to increase, the air-fuel ratio needs to be set to a considerably low ratio, which is usually a rich air-fuel ratio, so that the fuel injection amount can be set so as to prevent the air-fuel ratio from becoming excessively lean when the increase in the engine speed ends, and thereby to avoid misfires. Thus, the air-fuel ratio is made rich, and a large amount of unburned HC is therefore emitted.

As described above, if the fuel injection amount is reduced with an increase in the engine speed during engine start as in the conventional fuel controls, a large amount of unburned HC is generated, although the engine can be started. Namely, since the behavior of actual air-fuel ratios in engine cylinders during the engine start is not sufficiently determined in the conventional injection controls, a large amount of unburned HC is unavoidably generated.

SUMMARY OF THE INVENTION

It is an object of the invention to provide a fuel injection system for an internal combustion engine starting time and a control method thereof, which mainly achieve a reduction of unburned HC.

Therefore, according to an exemplary embodiment of the invention, in an internal combustion engine having a plurality of cylinders, there is provided a fuel injection system for an internal combustion engine starting time which sets an amount of fuel that is injected into each cylinder sequentially in a first cycle of the fuel injection during a normal engine start where an engine speed to increases, such that an amount of fuel injected into one of the cylinders in a last injection within the first cycle is larger than an amount of fuel injected into another one of the cylinders in a first injection within the first cycle.

According to a further exemplary embodiment of the invention, there is provided a control method for a fuel injection system for an internal combustion engine starting time having a plurality of cylinders. In this control method, an amount of fuel injected into each cylinder sequentially in a first cycle of fuel injection during a normal engine start in which an engine speed increases is set such that an amount of fuel injected into one of the cylinders in a last injection within the first cycle is larger than an amount of fuel injected into another one of the cylinders in a first injection within the first cycle.

As mentioned above, in order to suppress the generation of unburned HC during engine start, it is desirable to maintain the air-fuel ratio at the stoichiometric air-fuel ratio or at a slightly lean air-fuel ratio. The amount of fuel which evaporates from an inner surface of the cylinder of the internal combustion engine decreases as the engine speed increases. Accordingly, it is desirable to increase the fuel injection amount as the engine speed increases during engine start.

According to the above-mentioned fuel injection system for an internal combustion engine starting time and the control method thereof, the amount of the fuel which is injected into each cylinder sequentially in the first cycle of the fuel injection is set such that the amount of fuel injected into one of the cylinders in the last injection within the first cycle is larger than the amount of fuel injected into another one of the cylinders in the first injection within the first cycle. With this arrangement, it is possible to maintain the air-fuel ratio at the stoichiometric air-fuel ratio or at a slightly lean air-fuel ratio. Therefore, it is possible to suppress the generation of unburned HC during engine start.

BRIEF DESCRIPTION OF THE DRAWINGS

The above mentioned embodiment and other embodiments, objects, features, advantages, technical and industrial significance of this invention will be better understood by reading the following detailed description of exemplary embodiments of the invention, when considered in connection with the accompanying drawings, in which.

DETAILED DESCRIPTION OF THE EXEMPLARY EMBODIMENTS

In the following description and the accompanying drawings, the present invention will be described in more detail in terms of exemplary embodiments.

Figure 1:
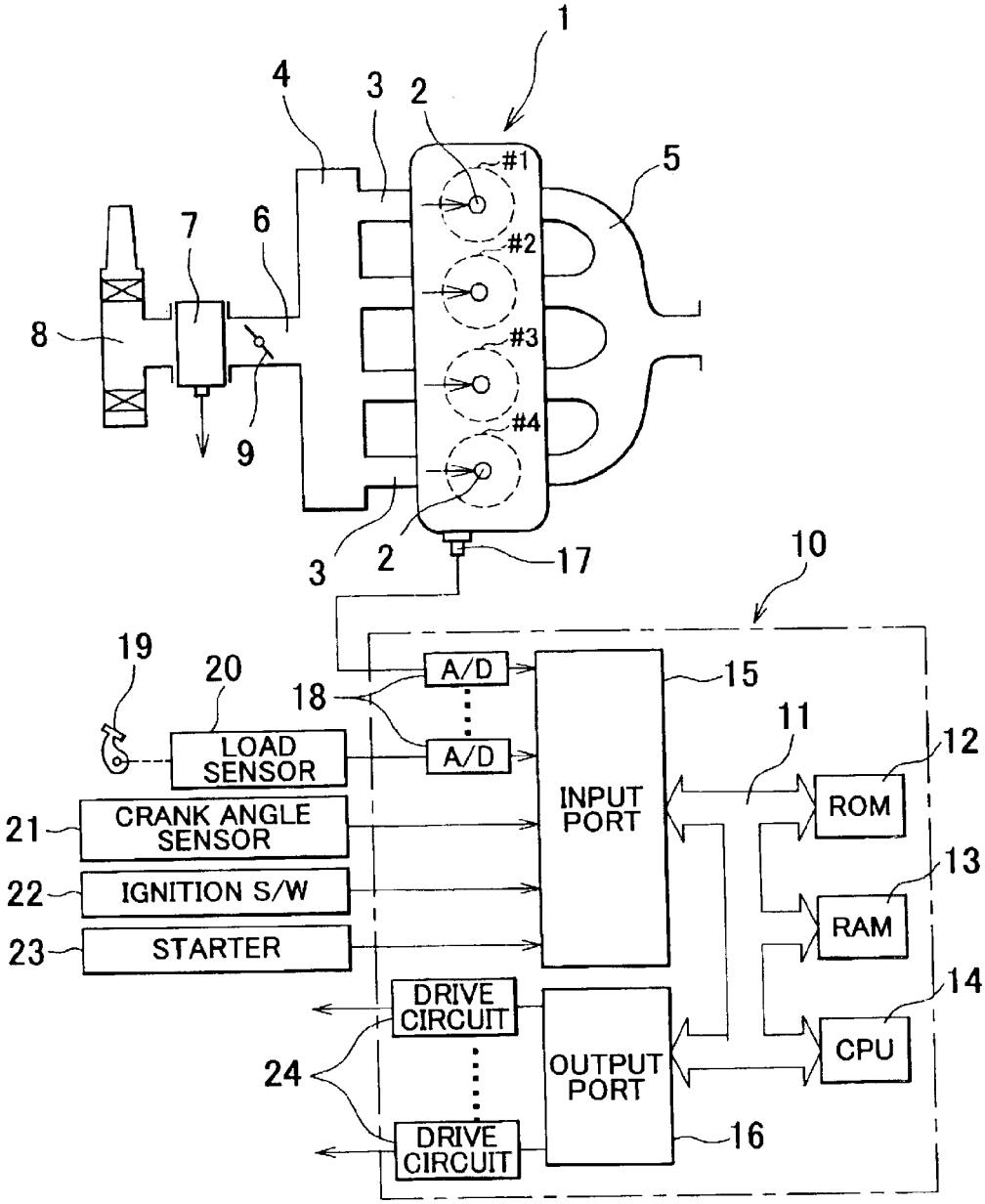
FIG. 1 is a view schematically showing an internal combustion engine of an in-cylinder fuel injection type to which a fuel injection system according to an embodiment of the invention is applied.

FIG. 1 shows a four-cylinder internal combustion engine of an in-cylinder fuel injection type in which fuel is directly injected into combustion chambers and the injected fuel is ignited using spark plugs. The invention is not limited to four-cylinder internal combustion engines as shown in FIG. 1, but may also be applied to other multi-cylinder internal combustion engines including a plurality of cylinders.

In FIG. 1, reference numeral 1 denotes an engine body including four cylinders, which consists of a first cylinder #1, a second cylinder #2, a third cylinder #3, and a fourth cylinder #4. Reference numeral 2 denotes fuel injection valves for injecting fuel into the combustion chambers of the cylinders #1, #2, #3, and #4. Reference numeral 3 denotes an intake manifold, reference numeral 4 denotes a surge tank, and reference numeral 5 denotes an exhaust manifold. The surge tank 4 is connected to an air cleaner 8 through an intake duct 6 and an intake amount measuring device 7. A throttle 9 is provided in the intake duct 6. The firing order of the internal combustion engine shown in FIG. 1 is #1-#3-#4-#2.

An electronic control unit 10 is mainly constituted of a digital computer including a read only memory (ROM) 12, a random access memory (RAM) 13, a microprocessor (CPU) 14, an input port 15, and an output port 16, all connected via a bidirectional bus 11. A coolant temperature sensor 17 for detecting the temperature of an engine coolant is mounted on the engine body 1. The output signals from the coolant temperature sensor 17, the intake air amount measuring instrument 7, and the other sensors are each input to the input port 15 through a corresponding one of A/D converters 18.

An accelerator pedal 19 is connected to a load sensor 20 which generates an output voltage proportional to the depression of the accelerator pedal 19. The output signal from the load sensor 20 is input to the input port 15 through the corresponding A/D converter 18. Also, there is provided a crank angle sensor 21 which generates an output pulse each time a crank shaft rotates, for example, 30 degrees, and this output pulse is input to the input port 15. Further, an ON/OFF signal from an ignition switch 22 and an ON/OFF signal from a starter switch 23 are input to the input port 15. The output port 16 is connected to the fuel injection valves 2, etc. through drive circuits 24.

Figure 2:
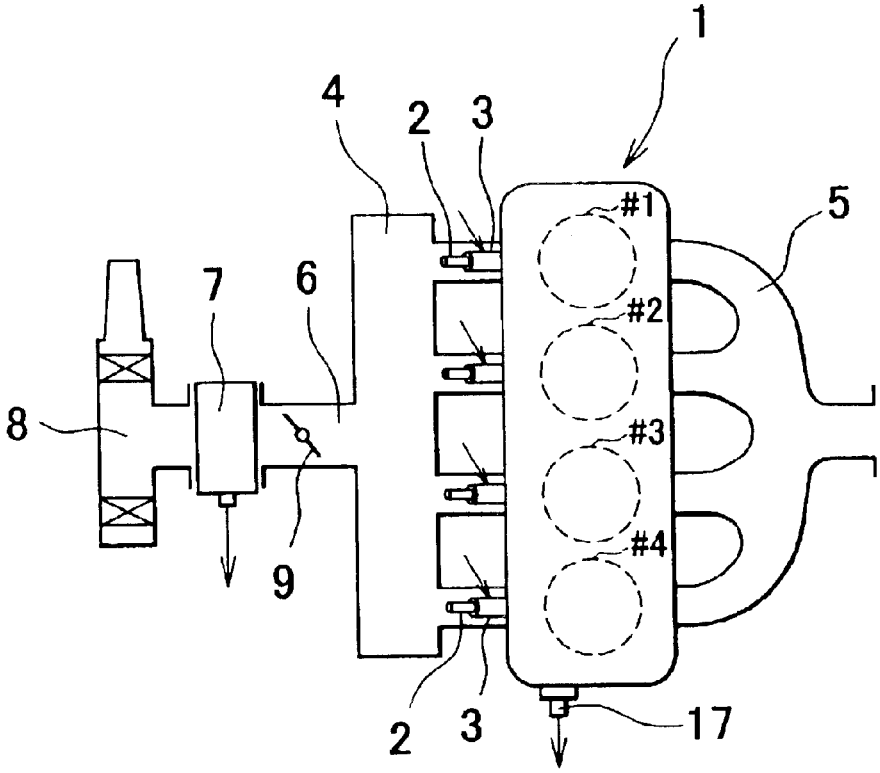
FIG. 2 is a view schematically showing an internal combustion engine of a port injection type to which the fuel injection system according to an embodiment of the invention is applied.

FIG. 2 shows a four-cylinder internal combustion engine of a port injection type in which fuel is injected from the fuel injection valve 2 to intake ports of the cylinders #1, #2, #3, and #4. The firing order of this internal combustion also is #1-#3-#4-#2. That is, the invention can be applied to both an in-cylinder injection type internal combustion engine as shown in FIG. 1 and a port injection type internal combustion engine as shown in FIG. 2.

Figure 3:
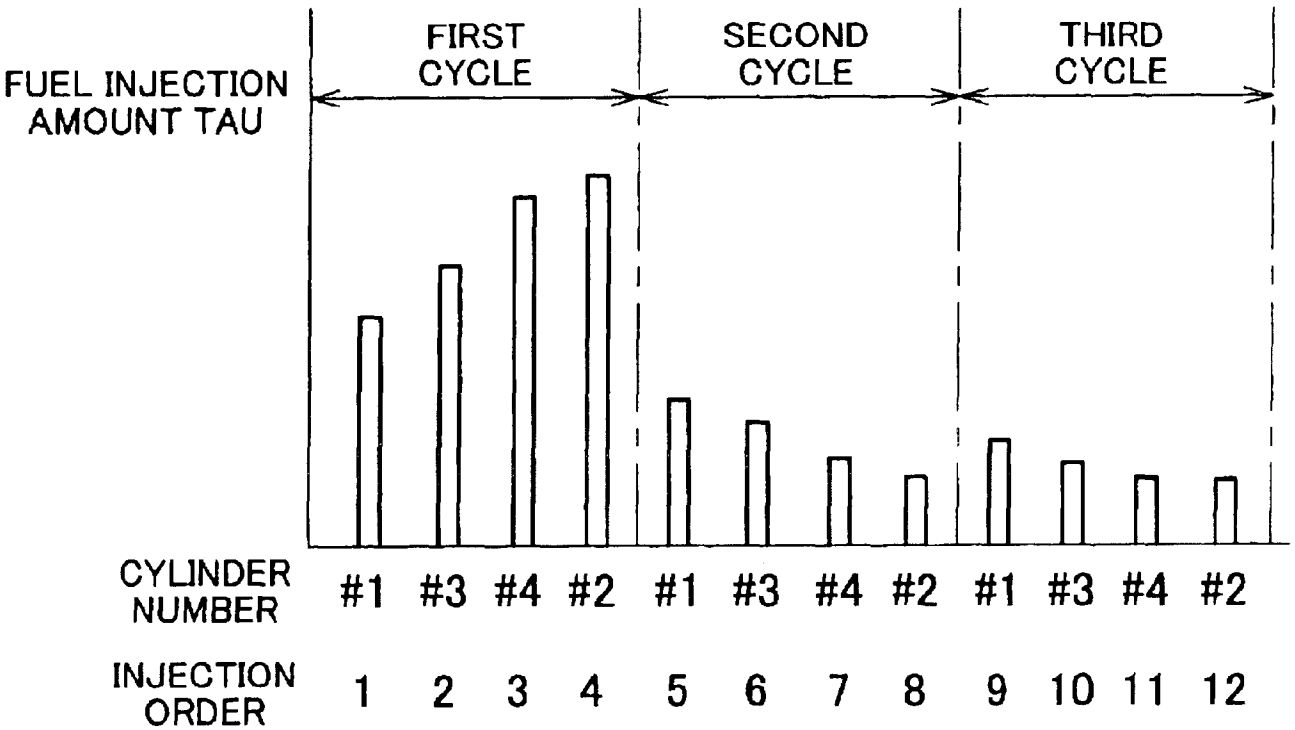
FIG. 3 is a graph illustrating fuel injection amounts to be injected into the cylinders in first to third cycles.

FIG. 3 shows a typical example of a fuel injection control according to the invention, which is performed during engine start. In FIG. 3, the vertical axis represents a fuel injection amount TAU during engine start. Indicated along the horizontal axis of FIG. 3 are numbers representing the order of injecting fuel from the start of fuel injection for starting the engine, and numbers of the cylinders into which fuel is sequentially injected. While fuel is first injected into the first cylinder #1 at the beginning of fuel injection in the example shown in FIG. 3, fuel may be injected into the cylinders in a different order if appropriate.

Referring to FIG. 3, there are three sequential cycles (i.e., first to third cycles) of fuel injection during engine start, in each of which fuel is injected into the cylinders in the order of #1-#3-#4-#2.

First, when fuel has been injected into the first cylinder #1 in the first cycle, the injected fuel is ignited by the spark plug, whereby the engine speed starts increasing. Then, fuel is subsequently injected into the third cylinder #3, the fourth cylinder #4, and the second cylinder #2, whereby the engine speed continues to increase unless an misfire occurs in any of the cylinders, that is, as long as the engine start proceeds normally.

In in-cylinder fuel injection type internal combustion engines as shown in FIG. 1, since fuel is ignited by the spark plug immediately after the fuel has been injected, the engine speed increases immediately after the fuel has been injected. Namely, in the in-cylinder fuel injection type internal combustion engine shown in FIG. 1, the engine speed increases each time fuel is injected from the first cycle in FIG. 3.

On the other hand, in the port injection type internal combustion engine shown in FIG. 2, fuel is first injected into the intake port, and thereafter is supplied into the combustion chamber during an intake stroke in each cylinder, and the fuel is then ignited by the spark plug at an end stage of a compression stroke after the piston passes a bottom dead center. Thus, it takes a long time before the fuel is ignited after injecting it into the intake port. For example, in the case shown in FIG. 3, the engine speed does not start to increase even when the third fuel injection is about to be performed in the first cycle, that is, even when fuel is about to be injected into the fourth cylinder #4. Namely, in the port injection type internal combustion engine shown in FIG. 1, the engine speed starts increasing with a considerable delay with respect to fuel injection. However, even in such a case, the engine speed continues to increase after the engine has been normally started.

As described previously, it is necessary to maintain the air-fuel ratio at the stoichiometric air-fuel ratio or at a slightly lean air-fuel ratio in order to suppress the generation of unburned HC during engine start. To achieve this, it is necessary to take into consideration the fuel which will evaporate from the inner surface and affect the air-fuel ratio as explained above. The amount of fuel which evaporates from the inner surface is proportional to the length of time until the piston reaches the vicinity of the top dead center for compression. Accordingly, as the engine speed increases, reduced amount of fuel evaporates from the inner surface. Therefore, it is necessary to increase the fuel injection amount as the engine speed increases in order to maintain the air-fuel ratio at the stoichiometric air-fuel ratio or at a slightly lean air-fuel ratio while the engine speed is increasing during engine start.

Accordingly, in the case shown in FIG. 3, the fuel injection amount TAU is progressively increased each time the fuel is injected into the cylinders during the first cycle of fuel injection. By increasing the fuel injection amount in this manner, the air-fuel ratio in the combustion chamber can be maintained at the stoichiometric air-fuel ratio or a slightly lean air-fuel ratio. Therefore, the emission of unburned HC is drastically reduced.

Meanwhile, a part of the fuel injected during the first cycle adheres to the inner surface and remains unburned. This fuel is subjected to combustion in the second cycle. Therefore, as a larger amount of fuel adheres to the inner surface in the first cycle, that is, as the fuel injection amount TAU in the first cycle is larger, a larger amount of fuel will remain unburned, and will be subjected to combustion in the second cycle. Thus, for suppressing the generation of unburned HC in the second cycle, it is desirable to reduce the fuel injection amount TAU for each cylinder in the second cycle with an increase in the fuel injection amount TAU for each cylinder in the first cycle, so that the air-fuel ratio is maintained at the stoichiometric air-fuel ratio or at a slightly lean air-fuel ratio. Accordingly, the fuel injection amount TAU in the second cycle is set smaller than the fuel injection amount in the first cycle, and the amount of fuel sequentially injected into the cylinders is progressively reduced at each injection in the second cycle.

Subsequently, fuel injections are performed in the third cycle in the same manner as the second cycle. That is, the fuel still remains adhered on the inner surface even after the second cycle. This fuel is then subjected to combustion in the third cycle. Therefore, as a larger amount of fuel adheres to the inner surface in the second cycle, that is, as the fuel injection amount TAU in the first cycle is larger, an increased amount of the fuel will remain unburned, and will be subjected to combustion in the third cycle. Thus, for suppressing the generation of unburned HC in the third cycle, it is desirable to reduce the fuel injection amount TAU in the third cycle with an increase the fuel injection amount TAU for each cylinder in the first cycle, so that the air-fuel ratio is maintained at the stoichiometric air-fuel ratio or at a slightly lean air-fuel ratio. Therefore, in the third cycle, the fuel injection amount TAU for each cylinder is set smaller than the amount of fuel injected into the same cylinder in the second cycle, and the amount of fuel sequentially injected into the cylinders is progressively reduced at each injection in the third cycle.

However, from the fourth cycle, since almost no fuel remains adhered on the inner surface, or the amount of the fuel adhered on the inner surface becomes substantially constant, the same fuel injection amount TAU is set for all the cylinders.

As aforementioned, the air-fuel ratio is maintained at the stoichiometric air-fuel ratio or at a slightly lean air-fuel ratio from the first cycle to the third cycle. Thus, the total amount of fuel burned during the first to third cycles is substantially the same among all the cylinders. In other words, the same amount of fuel is injected into each cylinder in total from the first cycle to the third cycle. While the fuel injection amount progressively decreases at each injection in two cycles, namely the second and third cycles following the first cycle, such decreasing fuel injection cycle may be repeated for a different number of times after the first cycle depending upon the type of engine, or the like.

Figure 4:
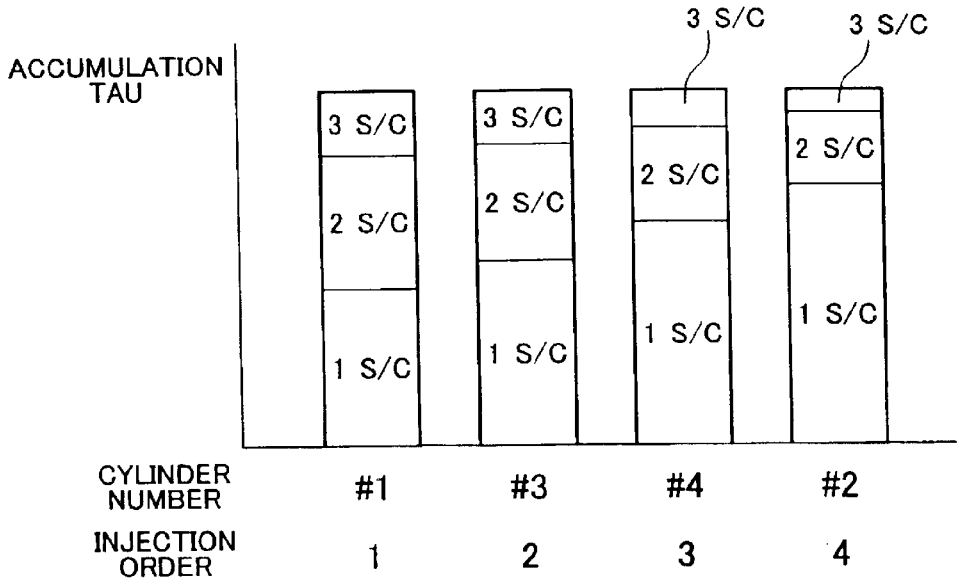
FIG. 4 is a graph illustrating accumulated amounts of fuel injected into the cylinders from the first cycle to the third cycle.

FIG. 4 shows an example of method for setting fuel injection amounts, in which the amount of fuel injected into each cylinder in each cycle is set such that the total amount of fuel injected from the first cycle to the third cycle, which may be a different predetermined cycle if appropriate as mentioned above, becomes the same among all the cylinders. In this embodiment, as can be understood from FIG. 4, the amount of fuel injected into each cylinder progressively decreases in each cycle from the first cycle to the third cycle.

In this method for setting fuel injection amounts, a target value TAUO of an accumulation TAU is first determined. The accumulation TAU represents the total amount of fuel injected from the first cycle to the third cycle. Next, the fuel injection amounts to be injected into the respective cylinders in each cycle are determined according to their proportions to the target value TAUO of the accumulation TAU in the following manner.

For the first cylinder #1 where the first injection is performed in each cycle, the fuel injection amount in the first cycle (1s/c) is set at TAUO×0.5, the fuel injection amount in the second cycle (2s/c) is set at TAUO×0.3, and the fuel injection amount in the third cycle (3s/c) is set at TAUO×0.2.

For the third cylinder #3 where the second fuel injection is performed in each cycle, the fuel injection amount in the first cycle (1s/c) is set at TAUO×0.6, the fuel injection amount in the second cycle (2s/c) is set at TAUO×0.25, and the fuel injection amount in the third cycle (3s/c) is set at TAUO×0.15.

For the fourth cylinder #4 where the third fuel injection is performed in each cycle, the fuel injection amount in the first cycle (1s/c) is set at TAUO×0.7, the fuel injection amount in the second cycle (2s/c) is set at TAUO×0.2, and the fuel injection amount in the third cycle (3s/c) is set at TAUO×0.1.

For the second cylinder where the fourth fuel injection is performed in each cycle, the fuel injection amount in the first cycle (1s/c) is set at TAUO×0.8, the fuel injection amount in the second cycle (2s/c) is set at TAUO×0.15, and the fuel injection amount in the third cycle (3s/c) is set at TAUO×0.05.

According to this method, it is possible to set the fuel injection amount to be injected into each cylinder in each cycle by determining the target value TAUO as shown in FIG. 3.

Figure 5:
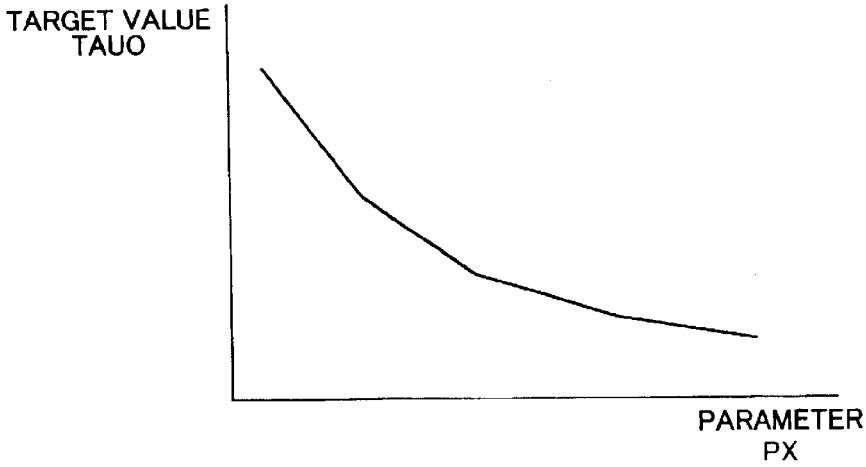
FIG. 5 is a graph showing a relationship between a target value of fuel injection amount and a corresponding parameter.

With the evaporation of the fuel adhered on the inner surface being promoted, the fuel injection amount TAU needed to maintain the air-fuel ratio at the stoichiometric air-fuel ratio or at a slightly lean air-fuel ratio decreases, and the target value TAUO for the accumulation TAU accordingly decreases. More specifically, the target value TAUO of the accumulation TAU, that is, the total amount of the fuel to be injected in each cycle from the first cycle to the third cycle is a function of a parameter PX which affects the evaporation of injected fuel. As shown in FIG. 5, the target value TAUO of the accumulation TAU decreases as the parameter PX changes in the direction of promoting the evaporation of injected fuel.

A typical example of the parameter PX is an engine coolant temperature. An increase in the engine coolant temperature indicates that the evaporation of fuel from the inner surface is being promoted. Thus, the target value TAUO of the accumulation TAU is set smaller as the engine coolant temperature increases.

Other examples of the parameter PX are the opening of an intake passage control valve provided in the intake port, the overlap amount between intake and exhaust valves, the assist air amount of an air assist type fuel injection valve, the temperature of fuel to be injected, the temperature of intake air, and the like.

For example, the intake passage control valve may be a type of valve for adjusting the cross sectional area of the passage in the intake port. When the opening amount of this control valve decreases, the flow rate of intake air flowing into the combustion chamber increases, which promotes the evaporation of fuel on the inner surface. In this case, the parameter PX is an inverse number of the opening amount of the valve.

Meanwhile, when the valve overlap amount between the intake and exhaust valves increases, the amount of the burned gas which flows back to the intake port increases, thereby promoting the evaporation of fuel adhered on the inner surface. For this reason, the valve overlap amount between the intake and exhaust valves may be used as the parameter PX.

When the assist air amount increases, the atomization of injected fuel is further promoted, whereby the amount of fuel which adheres to the inner surface decreases. For this reason, the assist air amount may be used as the parameter PX.

When the temperature of fuel to be injected increases, the atomization of injected fuel is further promoted, whereby the amount of fuel which adheres to the inner surface decreases. For this reason, the assist air amount may be used as the parameter PX.

Also, when the temperature of intake air increases, the atomization of injected fuel is further promoted, whereby the amount of fuel which adheres to the inner surfaces decreases. For this reason, the temperature of intake air may be used as the parameter PX.

If a plurality of the parameters PX are referred to for determining the evaporation state of fuel, the target value TAUO of the accumulation TAU is the product of the target values TAUOs obtained based on the parameters PX.

Next, a fuel injection control process during engine start will be described with reference to FIG. 6.

Figure 6:
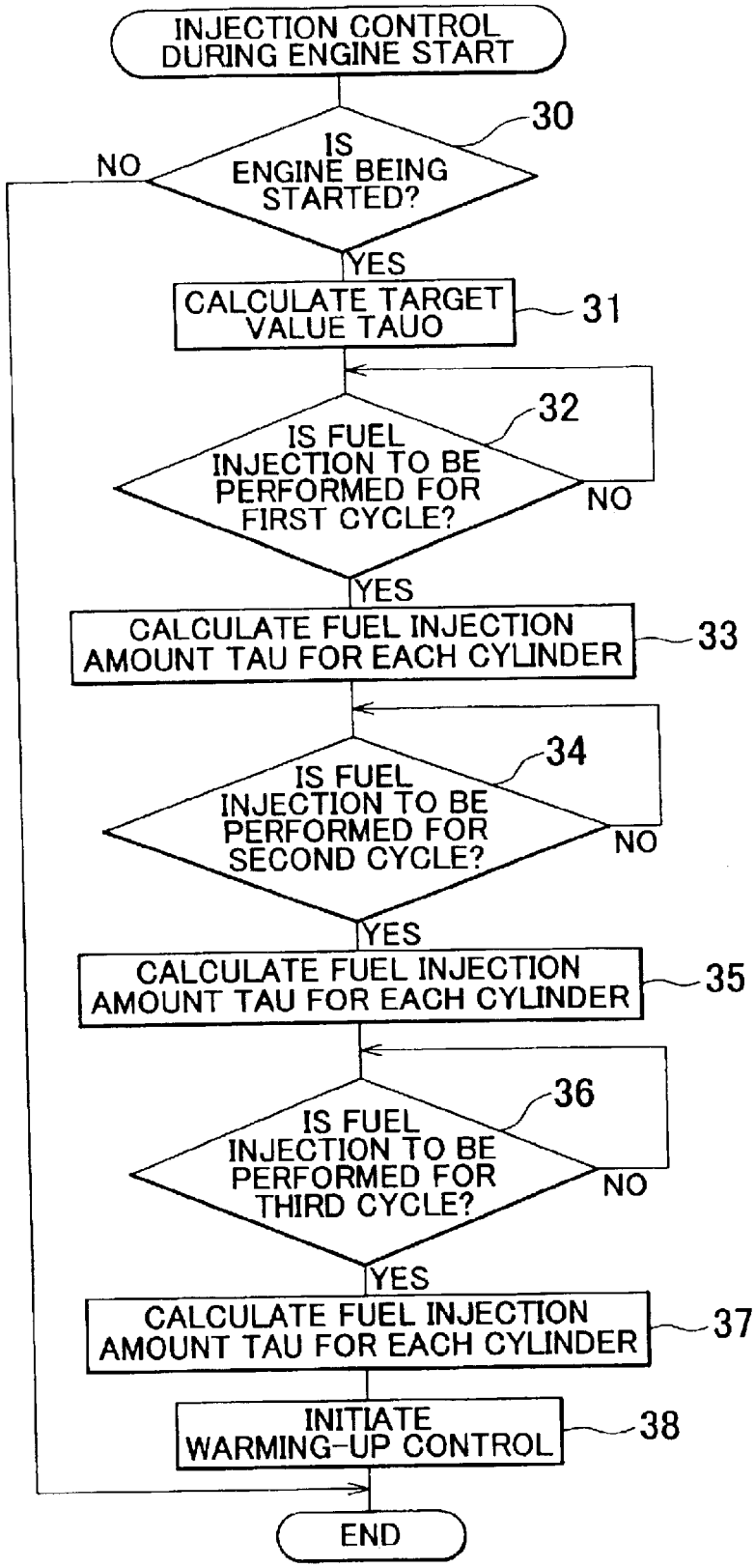
FIG. 6 is a flowchart showing a fuel injection control process to be performed during engine start.

Referring to FIG. 6, it is first determined in step S30 whether the engine is being started. It is determined that the engine is being started when the ignition switch 22 is turned from OFF to ON, or when the starter switch 23 is turned from OFF to ON. If "YES", namely if it is determined that the engine is being started, the process proceeds to step S31 to calculate the target value TAUO of the accumulation TAU based on the relationship shown in FIG. 5, after which the process proceeds to step S32.

In step S32, it is determined whether fuel injection is to be performed for the first cycle. If "YES", the process proceeds to step S33 where the fuel injection amount TAU for each cylinder is calculated. Here, the fuel injection amount TAU for the cylinder where the first fuel injection is to be performed is set at TAUO×0.5. The fuel injection amount TAU for the cylinder where the second injection is to be performed is set at TAUO×0.6. The fuel injection amount TAU for the cylinder where the third fuel injection is to be performed is set at TAUO×0.7. The fuel injection amount TAU for the cylinder where the fourth fuel injection is to be performed is set at TAUO×0.8. The process then proceeds to step S34.

In step S34, it is determined whether fuel injection is to be performed in the second cycle. If "YES", namely if it is determined that fuel injection is to be performed in the second cycle, the process proceeds to step S35 where the fuel injection amount TAU for each cylinder is calculated. Here, the fuel injection amount TAU for the cylinder where the first fuel injection is to be performed is set at TAUO×0.3. The fuel injection amount TAU for the cylinder where the second fuel injection is to be performed is set at TAUO×0.25. The fuel injection amount TAU for the cylinder where the third fuel injection is to be performed is set at TAUO×0.2. The fuel injection amount TAU for the cylinder where the fourth fuel injection is to be performed is set at TAUO×0.15. The process then proceeds to step S36.

In step S36, it is determined whether fuel injection is to be performed for in the third cycle. If "YES", namely if it is determined that fuel injection is to be performed in the third cycle, the process proceeds to step S37 where the fuel injection amount TAU for each cylinder is calculated. Here, the fuel injection amount TAU for the cylinder where the first fuel injection is to be performed is set at TAUO×0.2. The fuel injection amount TAU for the cylinder where the second fuel injection is to be performed is set at TAUO×

0.15. The fuel injection amount TAU for the cylinder where the third fuel injection is to be performed is set at TAUO× 0.1. The fuel injection amount TAU for the cylinder where the fourth fuel injection is to be performed is set at TAUO× 0.05. The process then proceeds to step S38, whereby the fuel injection control for engine start is terminated and the warming-up control initiates.

Figure 7A:
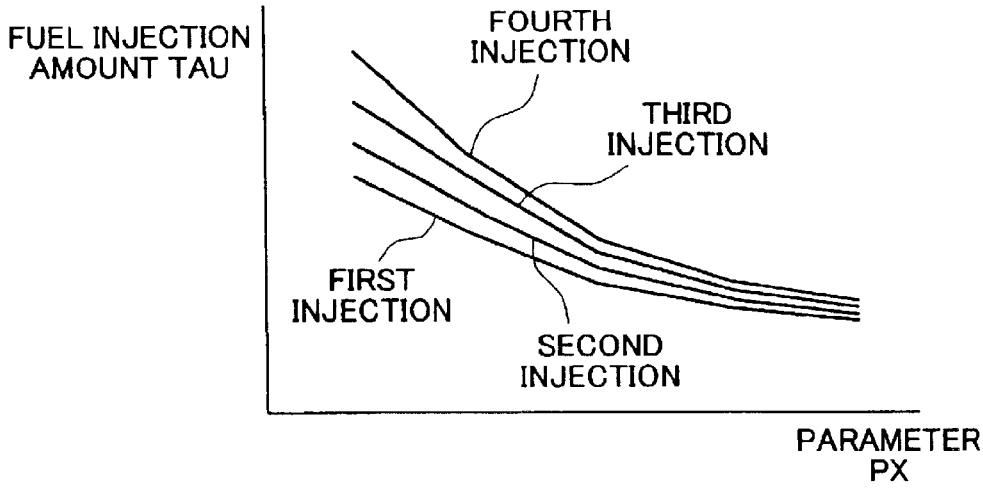
FIG. 7A is a graph illustrating a change in the fuel injection amounts at each injection.
Figure 7B:
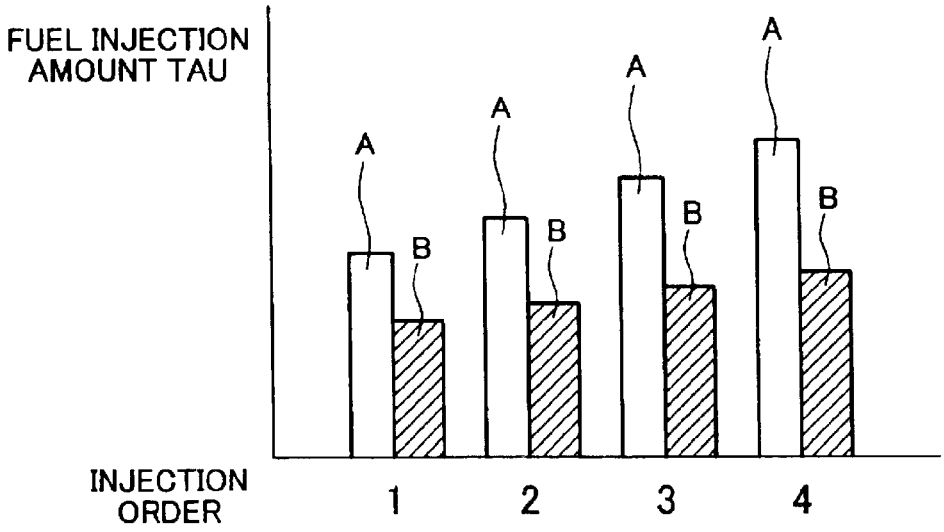
FIG. 7B is a graph illustrating fuel injection amounts in the first cycle.

FIGS. 7A and 71B show the case in which the fuel injection amount TAU for each cylinder in the first cycle is changed according to the above-mentioned parameter PX. Referring to FIG. 7A, as the parameter PX decreases, the fuel injection amounts TAU for the first to fourth injections all increase, while maintaining the relationship of "injection amount in the first injection<injection amount in the second injection<injection amount in the third injection<injection amount in the fourth injection". In FIG. 7B, "A" indicates the fuel injection amounts TAU set when the parameter PX is relatively small, whereas "B" indicates the fuel injection amounts TAU set when the parameter PX is relatively large.

As can be understood form FIGS. 7A and 7B, in the first cycle, the difference in the fuel injection amount between the fuel injection amount TAU for the cylinder in which the first injection occurs and the fuel injection amount TAU for the cylinder in which the last injection occurs, which is the fourth injection in the embodiment, is to be performed is a function of the parameter PX. This difference decreases as the parameter PX increases, that is, as the parameter PX changes in the direction of promoting the evaporation of injected fuel. Also, the increasing rate of the fuel injection amount TAU for the cylinder where the last injection is to be performed with respect to the fuel injection amount TAU for the cylinder in the first injection is also a function of the parameter PX. This increasing rate decreases as the parameter PX increases, that is, as the parameter PX changes in the direction of promoting the evaporation of injected fuel.

When the fuel injection amounts indicated by "B"-are used according to the parameter PX being relatively small, the amount of air-fuel mixture formed in each combustion chamber is as large as necessary to control the air-fuel ratio to the stoichiometric air-fuel ratio or a slightly lean air-fuel ratio. When the parameter PX decreases from this state, the amount of air-fuel mixture in each cylinder decreases at the same rate. Accordingly, in order to control the air-fuel ratio to the stoichiometric air-fuel ratio or a slightly lean air-fuel ratio while the parameter PX is decreasing, it is necessary to increase the air-fuel mixture in each cylinder at the same rate. To achieve this, it is necessary to increase the fuel injection amount in each cylinder at the same rate. Therefore, the increasing rate of the fuel injection amount indicated by "A" with respect to the fuel injection amount TAU indicated by "B" is the same among the first to fourth injections, namely among all the cylinders.

Thus, when the parameter PX is small and the fuel injection amounts TAU indicated by "A" are sequentially injected, the increasing rate of fuel injection amount from the first injection to the last injection becomes larger than when the parameter PX is large and the fuel injection amounts TAU indicated by "B" are sequentially injected. Accordingly, the difference in the fuel injection amount between the first injection and the last injection decreases as the parameter PX increases, and the increasing rate of fuel injection amount from the first injection to the last injection decreases as the parameter PX increases.

In the case where the target value TAUO of the accumulation TAU is set as shown in FIG. 4, when the fuel injection amount TAU for each cylinder in the first cycle is determined as shown in FIG. 7, the fuel injection amount TAU for each cylinder in the second cycle and the fuel injection amount TAU for each cylinder in the third cycle are set by dividing the remaining fuel injection amount at a predetermined proportion, for example, 2:1.

Next, another method for determining the fuel injection amounts TAU will be described. In this method, the fuel injection amount TAU for each cylinder in the second cycle and the fuel injection amount TAU for each cylinder in the third cycle are determined in a different manner from described above after the fuel injection amount TAU for each cylinder in the first cycle has been determined as shown in FIGS. 7A. and 7B.

As mentioned above, a part of the injected fuel which adheres to the inner surface in the first cycle forms an air-fuel mixture in the second cycle. Therefore, it is desirable to reduce the fuel injection amount TAU in the second cycle as the fuel injection amount TAU in the first cycle increases. Therefore, in the case where the fuel injection amounts TAU are set large in the first cycle and the increasing rate of the fuel injection amount from the first injection to the last injection is made large such as when the fuel injection amounts TAU indicated by "A" in FIG. 7B are injected, it is desirable in the second cycle to set smaller fuel injection amounts TAU and achieve a larger decreasing rate of the fuel injection amount from the first injection to the last injection, as compared to the case where the fuel injection amounts TAU indicated by "B" are injected.

According to the embodiment, therefore, in the first cycle, the increasing rate from the amount of fuel to be injected into the cylinder in the first injection to the fuel injection amount for other cylinders where a succeeding fuel injection is to be performed, such as the cylinder where the last injection is to be performed, is first calculated. Then, in the second cycle, the decreasing rate from the fuel injection amount for the cylinder in the first injection to the fuel injection amount for other cylinders where a succeeding fuel injection is to be performed, such as the cylinder where the last injection is be performed, is determined according to the above-mentioned increasing rate in the first cycle. Thus, as shown in FIG. 8C, the decreasing rate of the fuel injection amount in the second cycle increases as the increasing rate of the fuel injection amount in the first cycle increases.

Figure 8A:
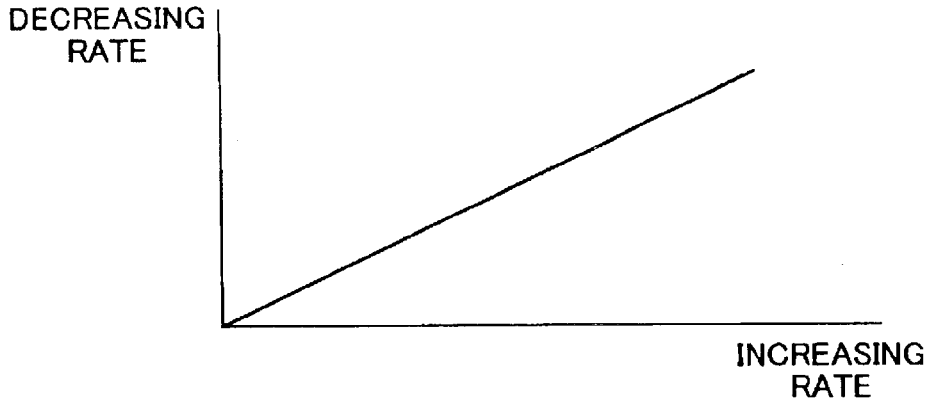
FIG. 8A is a graph showing a relationship between an increasing rate of fuel injection amount in the first cycle and a decreasing rate of the fuel injection amount in the second cycle.

According to the embodiment of the invention, the relationship shown in FIG. 8A is also applied when determining the fuel injection amounts TAU in the third cycle. Namely, as shown in FIG. 8A, the decreasing rate of the fuel injection amount in the third cycle increases as the increasing rate of the fuel injection amount in the first cycle increases.

Figure 8B:
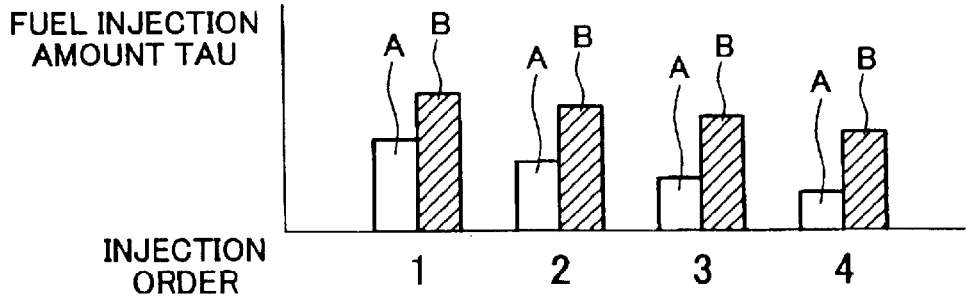
FIG. 8B is a graph illustrating fuel injection amounts in the second cycle.
Figure 8C:
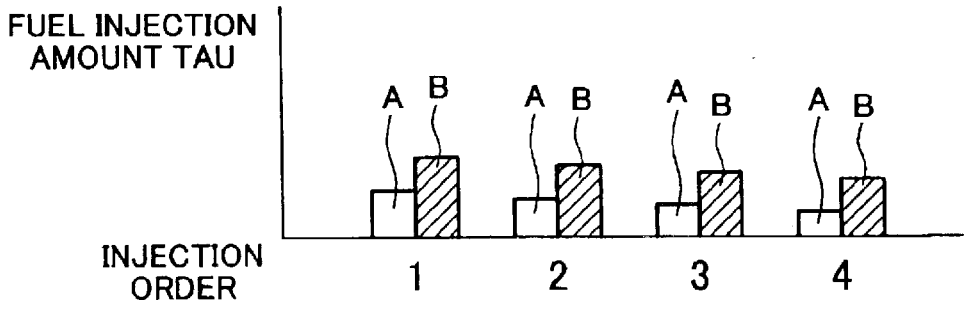
FIG. 8C is a graph illustrating fuel injection amounts in the third cycle.

FIG. 8B shows the fuel injection amounts TAU in the second cycle, and FIG. 8C shows the fuel injection amounts TAU in the third cycle. As can be understood by comparing FIG. 7B and FIG. 8B, in the second cycle, the fuel injection amounts TAU indicated by "A" are set smaller and the decreasing rate of the fuel injection amount from the first injection to the last fuel injection is large, as compared to the case where the fuel injection amounts TAU indicated by "B" are injected. As can be understood by comparing FIG. 7B and FIG. 8C, in the third cycle, the fuel injection amounts TAU indicated by "A" are set still smaller, and the decreasing rate of the fuel injection amount from the first fuel injection to the last fuel injection is large, as compared to the case where the fuel injection amounts TAU indicated by "B" are injected.

Figure 9A:
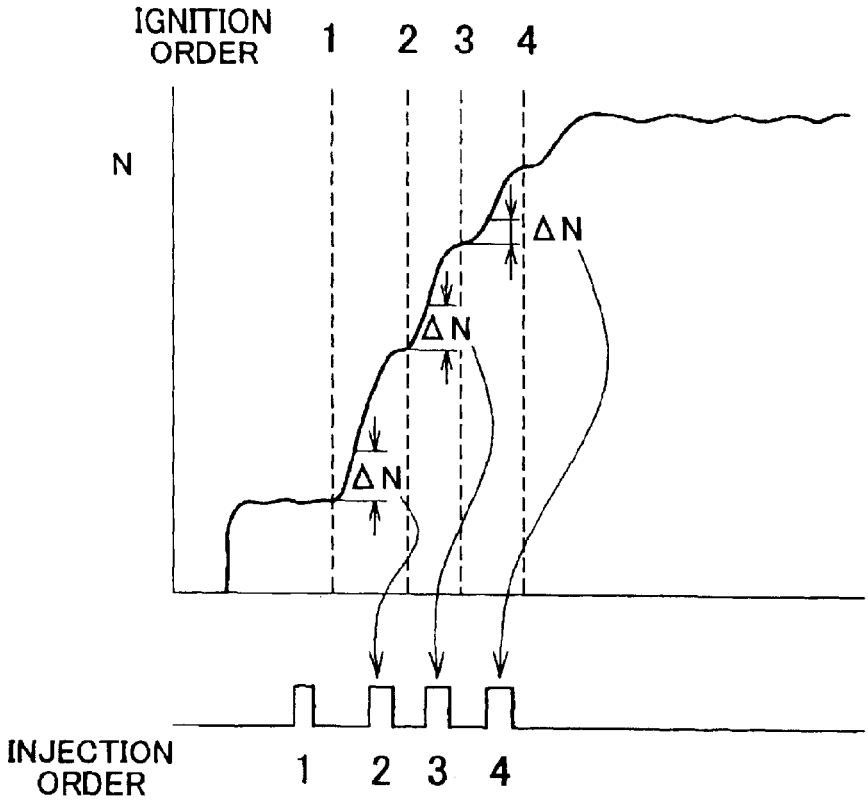
FIG. 9A and FIG. 9B are graphs for explaining a relationship between changes in the engine speed and the fuel injection amount, established during start of the internal combustion engine of an in-cylinder fuel injection type.
Figure 9B:
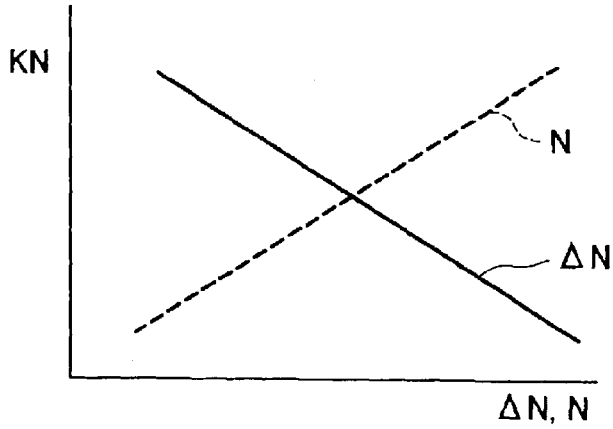

FIGS. 9A and 9B show an example in which the fuel injection amount for one of the cylinders is determined based on the rate of an increase in the engine speed resulting from an ignition in another of the cylinders into which fuel has been previously injected in an internal combustion engine of an in-cylinder fuel injection type as shown in FIG. 1.

FIG. 9A illustrates changes in the engine speed N. Referring to FIG. 9A, the engine speed N starts to increase when the fuel injected in the first injection is ignited for starting the engine. At this time, the amount of increase in the engine speed N per an unit time, that is, an increasing rate AN of the engine speed N is calculated, and the second injection amount TAU is calculated based on the calculated increasing rate ΔN using the following equation.

$$TAU=TP\times KN$$

Here, TP represents a pre-stored basic fuel injection amount, and KN is a correction coefficient which becomes smaller as the increasing rate ΔN increases, as indicated by a solid line in FIG. 9B. Thus, according to the above equation, the fuel injection amount TAU for the second injection is set smaller as the increasing rate ΔN of the engine speed N is larger.

Then, after performing the second injection, the injection amount TAU for the third injection is calculated based on the increasing rate A of the engine speed N, namely the rate of an increase in the engine speed N resulting from an ignition of the fuel injected in the second injection. Then, after performing the third injection, the injection amount TAU for the fourth injection is calculated based on the increasing rate ΔN of the engine speed N, namely the rate of an increase in the engine speed N resulting from an ignition of the fuel injected in the third injection.

When the air-fuel ratio of the air-fuel mixture formed in the combustion chamber becomes rich, the increasing rate ΔN of the engine speed N increases. Therefore, the fuel injection amount TAU for a succeeding injection is reduced. On the other hand, when the air-fuel ratio of the air-fuel mixture formed in the combustion chamber becomes considerably lean, the increasing rate AN of the engine speed N decreases. Therefore, the fuel injection amount TAU for a succeeding injection is increased. Thus, in the embodiment, when the engine speed is increasing during engine start, the air-fuel ratio is maintained at the stoichiometric air-fuel ratio or at a slightly lean air-fuel ratio, at which only a small amount of unburned HC is generated.

As described so far, in the embodiment, the air-fuel ratio is maintained at a slightly lean air-fuel ratio. Accordingly, when the engine speed is increasing during engine start, the fuel injection amount progressively increases.

In the embodiment, it is also possible to calculate the fuel injection amounts TAU for engine start using the following equation.

$$TAU=TP\times KN$$

Here, as mentioned above, TP represents the pre-stored basic fuel injection amount, and KN is the correction coefficient which increases as the engine speed N increases, as indicated by the dashed line in FIG. 9B. In this case, the fuel injection amount TAU for each cylinder is a product of the correction coefficient KN, which is determined based on the engine speed N obtained during fuel injections, and the basic fuel injection amount TP. Accordingly, in this case, the correction coefficient KN is made larger as the engine speed N increases. Thus, the fuel injection amount progressively increases while the engine speed N is increasing.

Figure 10A:
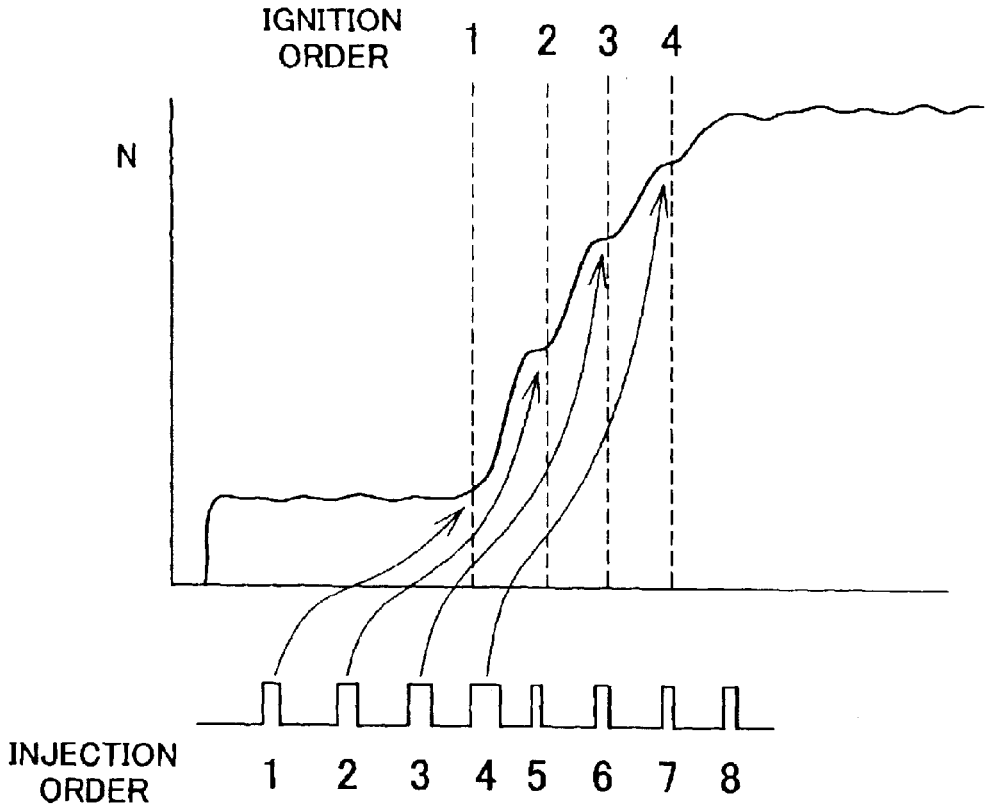
FIG. 10A and FIG. 10B are graphs for explaining a relationship between changes in the engine speed and the fuel injection amount, established during start of the internal combustion engine of a port injection type.
Figure 10B:
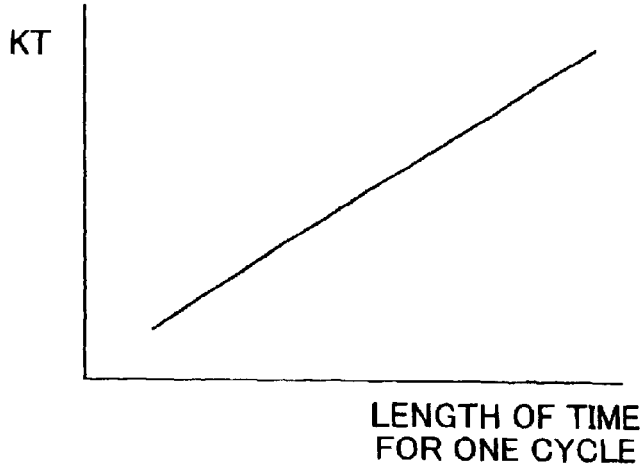

Next, a second embodiment will be described. FIGS. 10A and 10B show the second embodiment in which the fuel injection amount TAU in the first cycle of the next engine start is determined based on the increasing rate of the engine speed N obtained during the present engine start. FIGS. 10A and 10B show the relationship among the injection timing, the ignition timing, and the engine speed N in the internal combustion engine of a port injection type shown in FIG. 2. The fuel injected in the first injection is ignited in the first ignition, the fuel injected in the second injection is ignited in the second ignition, the fuel injected in the third injection is ignited in the third ignition, and the fuel injected in the fourth injection is ignited in the fourth ignition. As can be understood from FIG. 10A, in the port injection type internal combustion engine, the engine speed N increases with a delay from fuel injections.

In the embodiment, as a typical value indicative of the increasing rate of the engine speed N during engine start, the elapsed time in the first cycle is employed. The fuel injection amount TAU in the first cycle of the next engine start is calculated using the following equation.

$$TAUt=TAU\times KT$$

Here, TAU represents a fuel injection amount which is set so as to suppress the generation of unburned HC in the first cycle of the next engine start, and KT is a correction coefficient which increases as the elapsed time in the first cycle of the present engine start is longer, as shown in FIG. 10B. According to the above equation, if the elapsed time in the first cycle of the present engine start becomes longer, the fuel injection amount TAUt for the first cycle of the next engine start will be increased.

In the embodiment, for example, when heavy fuel which is difficult to evaporate is used, the air-fuel ratio increases. Therefore, the elapsed time in the first cycle becomes long so as to prevent the generation of increased amount of unburned HC. In this case, the fuel injection amount TAUt in the first cycle of the next engine start is increased so that the air-fuel ratio is maintained at the stoichiometric air-fuel ratio or at a slightly lean air-fuel ratio while the engine speed is increasing, thereby suppressing the generation of unburned HC.

When deposits adhere to a back surface of the umbrella portion of the intake valve, and the like, it increases the amount of fuel which adheres to the inner surface. This results in increased air-fuel ratio, which causes the generation of increased amount of unburned HC, and which causes the elapsed time in the first cycle to be longer. Also in this case, in the embodiment, the fuel injection amount TAUt in the first cycle of the next engine start is increased so that the air-fuel ratio at the stoichiometric air-fuel ratio or at a slightly lean air-fuel ratio is maintained while the engine speed is increasing, whereby the generation of unburned HC is suppressed.

Figure 11A:
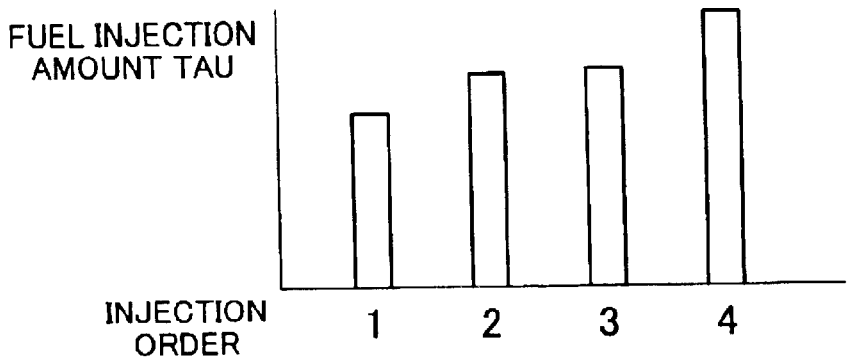
FIG. 11A, FIG. 11B, and FIG. 11C are graphs showing other examples in which the fuel injection amount changes at each injection.

In the first and second embodiments described above, the fuel injection amount for each cylinder progressively increases at each injection in the first cycle during engine start. However, as shown in FIG. 11A, the same fuel injection amount TAU may be set for the second and third injections as long as the fuel injection amount TAU for the last injection is larger than the fuel injection amount TAU for the first injection. In this case, too, it is possible to suppress the emission of unburned HC.

Figure 11B:
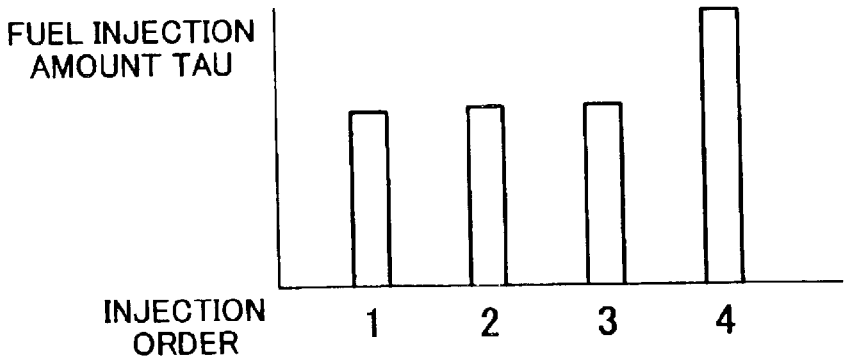

Likewise, as shown in FIG. 11B, the same fuel injection amount TAU may be set for the first to third injections as long as the fuel injection amount TAU for the last injection is larger than the fuel injection amount TAU for the first injection. In this case, too, it is possible to suppress the emission of unburned HC. That is, it is possible to suppress the emission of unburned HC as long as the fuel injections TAU in the first cycle are set such that the fuel injection amount TAU in the last injection is larger than the fuel injection amount TAU in the first injection, and such that any of the fuel injection amounts TAU is not smaller than the fuel injection amount TAU for a preceding injection.

Also, there are known internal combustion engines which employ a cylinder determining method for determining a cylinder into which fuel is to be next injected based on a signal that is generated each time the crankshaft rotates once, and a signal that is generated each time the camshaft rotates once. In this cylinder determining method, it is possible to determine the cylinders for the second and succeeding injections. According to this method, however, although it is possible to determine two of the cylinders moving up-and-down in synchronization in either of which the first injection is to be performed, it is not possible to discriminate between those two cylinders. Accordingly, when this cylinder determining method is employed, the same amounts of fuel are simultaneously injected into the cylinders in the first and third injections, which are the first and fourth cylinders #1, #4, in the embodiment.

Figure 11C:
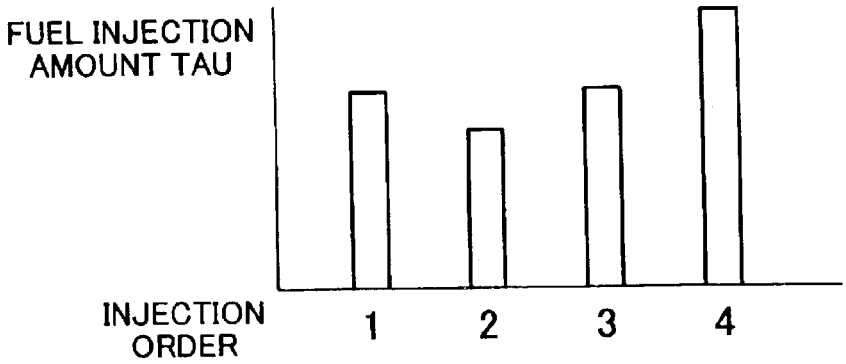

When the invention is applied to the internal combustion engine which employs this cylinder determining method, as shown in FIG. 11C, the first injection amount TAU and the third injection amount TAU are equal to each other in the first cycle during engine start. However, the second injection amount TAU is smaller than the first injection amount TAU and the third injection amount TAU, and the fourth injection amount TAU is larger than the first injection amount TAU and the third injection amount TAU. Even in this case, since the fourth injection amount TAU is larger than the first injection amount TAU, the emission of unburned HC is suppressed.

Namely, the emission of unburned HC can be suppressed if fuel injection amounts to be sequentially injected in the first cycle during normal engine start where the engine speed continues to increase are set such that the fuel injection amount for the last injection is larger than the fuel injection amount for the first injection.

It is possible to suppress the emission of unburned HC during engine start.

The controller (e.g., the ECU 10) of the illustrated exemplary embodiments is implemented as a programmed general purpose computer. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller can be a plurality of separate dedicated or programmable integrated or other electronic circuits or devices (e.g., hardwired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

While the invention has been described with reference to exemplary embodiments thereof, it is to be understood that the invention is not limited to the exemplary embodiments and constructions. To the contrary, the invention is intended to cover various modifications and equivalent arrangements. In addition, while the various elements of the exemplary embodiments are shown in various combinations and configurations, which are exemplary, other combinations and configuration, including more, less or only a single element, are also within the spirit and scope of the invention.

What is claimed is:

1. A fuel injection system for an internal combustion engine starting time, comprising:

a plurality of cylinders; and a controller which sets an amount of fuel injected into each cylinder sequentially in a first cycle of fuel injection during a normal engine start where an engine speed increases, such that an amount of fuel to be injected into one of the cylinders in a last injection within the first cycle is larger than an amount of fuel to be injected into another one of the cylinders in a first injection within the first cycle.

2. The fuel injection system according to claim 1, wherein the controller sets the fuel injection amount for each of the cylinders in the first cycle such that an amount of fuel to be injected into any one of the cylinders is not smaller than an amount of fuel which is injected into a different one of the cylinders at an earlier time during the first cycle.

3. The fuel injection system according to claim 2, wherein the controller progressively increases an amount of fuel to be injected into each cylinder at each injection during the first cycle.

4. The fuel injection system according to claim 3, wherein the controller progressively reduces an amount of fuel to be injected into each cylinder at each injection in a second cycle following the first cycle.

5. The fuel injection system according to claim 1, wherein the controller sets an amount of fuel to be injected into each cylinder such that a total amount of fuel injected from the first cycle to a predetermined subsequent cycle is the same for all the cylinders.

6. The fuel injection system according to claim 5, wherein the controller progressively reduces the amount of fuel to be injected into each cylinder in each cycle from the first cycle to the predetermined subsequent cycle.

7. The fuel injection system according to claim 6, wherein a total amount of fuel to be injected into each cylinder is a function of a parameter which affects evaporation of the injected fuel, and the total amount of injected fuel decreases as the parameter changes in a direction that promotes the evaporation of the injected fuel.

8. The fuel injection system according to claim 7, wherein the parameter is a temperature of an engine coolant, and the total amount of the injected fuel decreases as the temperature of the engine coolant increases.

9. The fuel injection system according to claim 7, wherein the parameter is at least one parameter selected from an opening amount of an intake passage control valve provided in an intake port, a valve overlap amount between an intake valve and an exhaust valve, an assist air amount of an air assist type fuel injection valve, a temperature of fuel to be injected, and a temperature of intake air.

10. The fuel injection system according to claim 1, wherein a difference between an amount of fuel to be injected into the one of the cylinders in the first injection of the first cycle and an amount of fuel to be injected into the another one of the cylinders in the last injection of the first cycle is a function of a parameter which affects evaporation of the injected fuel, and the difference decreases as the parameter changes in a direction that promotes the evaporation of the injected fuel.

11. The fuel injection system according to claim 10, wherein the parameter is a temperature of an engine coolant, and the difference in the fuel injection amount decreases as the temperature of the engine coolant increases.

12. The fuel injection system according to claim 10, wherein the parameter is at least one parameter selected from an opening amount of an intake passage control valve provided in an intake port, a valve overlap amount between an intake valve and an exhaust valve, an assist air amount of an air assist type fuel injection valve, a temperature of fuel to be injected, and a temperature of intake air.

13. The fuel injection system according to claim 1, wherein an increasing rate of an amount of fuel to be injected into the one of the cylinders in the last injection of the first cycle with respect to an amount of fuel to be injected into the another one of the cylinders in the first injection of the first cycle is a function of a parameter which affects evaporation of the injected fuel, and the increasing rate decreases as the parameter changes in a direction that promotes the evaporation of the injected fuel.

14. The fuel injection system according to claim 13, wherein the parameter is a temperature of an engine coolant, and the increasing rate decreases as the temperature of the engine coolant increases.

15. The fuel injection system according to claim 13, wherein the parameter is at least one parameter selected from an opening amount of an intake passage control valve provided in an intake port, a valve overlap amount between an intake valve and an exhaust valve, an assist air amount of an air assist type fuel injection valve, a temperature of fuel to be injected, and a temperature of intake air.

16. The fuel injection system according to claim 1, wherein the controller determines an increasing rate from an amount of fuel to be injected into the one of the cylinders in the first injection of the first cycle to an amount of fuel to be injected into the rest of the cylinders during the first cycle, and the controller determines a decreasing rate from an amount of fuel to be injected into the one of the cylinders in a first injection of a second cycle following the first cycle to the amount of fuel to be injected into the rest of the cylinders during the second cycle based on the increasing rate.

17. The fuel injection system according to claim 1, wherein the controller determines an amount of fuel to be next injected into any one of the cylinders based on a rate of an increase in an engine speed resulting from an ignition of fuel which is injected into a different one of the cylinders at an earlier time during the first cycle.

18. The fuel injection system according to claim 1, wherein the controller determines a fuel injection amount in the first cycle of a next engine start based on an increasing rate of an engine speed obtained during a present engine start.

19. The fuel injection system according to claim 1, wherein the cylinders in the internal combustion engine comprise at least four cylinders.

20. A control method of a fuel injection system for an internal combustion engine that includes a plurality of cylinders, comprising the step of:

setting an amount of fuel injected into each cylinder sequentially in a first cycle of fuel injection during a normal engine start in which an engine speed increases, such that an amount of fuel to be injected into one of the cylinders in a last injection within the first cycle is larger than an amount of fuel to be injected into another one of the cylinders in a first injection within the first cycle.

21. The control method according to claim 20, further comprising the step of:

setting the fuel injection amount for each of the cylinders in the first cycle such that an amount of fuel to be injected into any one of the cylinders does not become smaller than an amount of fuel to be injected into another of the cylinders into which fuel is injected at an earlier time during the first cycle.

22. The control method according to claim 21, wherein an amount of fuel to be injected into each cylinder is progressively increased at each injection in the first cycle.

23. The control method according to claim 22, further comprising the step of:

progressively reducing an amount of fuel to be injected into each cylinder at each injection in a second cycle following the first cycle.

24. The control method according to claim 20, further comprising the step of:

setting an amount of fuel to be injected into each cylinder such that a total amount of fuel injected from the first cycle to a predetermined subsequent cycle is the same for all the cylinders.

25. The control method according to claim 24, further comprising the step of:

progressively reducing the amount of fuel to be injected into each cylinder in each cycle from the first cycle to the predetermined subsequent cycle.

26. The control method according to claim 24, wherein a total amount of fuel to be injected into each cylinder is a function of a parameter which affects evaporation of the injected fuel, and the total amount of the injected fuel decreases as the parameter changes in a direction that promotes the evaporation of the injected fuel.

27. The control method according to claim 26, wherein the parameter is a temperature of an engine coolant, and the total amount of the injected fuel decreases as the temperature of the engine coolant increases.

28. The control method according to claim 26, wherein the parameter is at least one parameter selected from an opening amount of an intake passage control valve provided in an intake port, a valve overlap amount between an intake valve and an exhaust valve, an assist air amount of an air assist type fuel injection valve, a temperature of fuel to be injected, and a temperature of intake air.

29. The control method according to claim 20, wherein a difference between the amount of fuel to be injected into the one of the cylinders in the first injection of the first cycle and the amount of fuel to be injected into the another one of the cylinders in the last injection of the first cycle is a function of a parameter which affects evaporation of the injected fuel, and the difference decreases as the parameter changes in a direction that promotes the evaporation of the injected fuel.

30. The control method according to claim 29, wherein the parameter is a temperature of an engine coolant, and the difference between the fuel injection amounts decreases as the temperature of the engine coolant increases.

31. The control method according to claim 29, wherein the parameter is at least one parameter selected from an opening amount of an intake passage control valve provided in an intake port, a valve overlap amount between an intake valve and an exhaust valve, an assist air amount of an air assist type fuel injection valve, a temperature of fuel to be injected, and a temperature of intake air.

32. The control method according to claim 20, wherein an increasing rate of the amount of fuel to be injected into the one of the cylinders in the last injection of the first cycle with respect to the amount of fuel to be injected into the another one of the cylinder in the first injection of the first cycle is a function of a parameter which affects evaporation of the injected fuel, and the increasing rate decreases as the parameter changes in a direction that promotes the evaporation of the injected fuel.

33. The control method according to claim 32, wherein the parameter is a temperature of an engine coolant, and the increasing rate decreases as the temperature of the engine coolant increases.

34. The control method according to claim 32, wherein the parameter is at least one parameter selected from an opening amount of an intake passage control valve provided in an intake port, a valve overlap amount between an intake valve and an exhaust valve, an assist air amount of an air assist type fuel injection valve, a temperature of fuel to be injected, and a temperature of intake air.

35. The control method according to claim 20, further comprising the steps of:

determining an increasing rate from the amount of fuel to be injected into the one of the cylinders in the first injection of the first cycle to the amount of fuel to be injected into the rest of the cylinders during the first cycle; and determining a decreasing rate from the amount of fuel to be injected into the one of the cylinders in the first injection of a second cycle following the first cycle to the amount of fuel to be injected into the rest of the cylinders during the second cycle based on the increasing rate.

36. The control method according to claim 20, further comprising the step of:

determining an amount of fuel to be next injected into any one of the cylinders based on a rate of an increase in an engine speed resulting from an ignition of fuel which is injected into a different one of the cylinders at an earlier time during the first cycle.

37. The control method according to claim 20, further comprising the step of:

determining a fuel injection amount in the first cycle of a next engine start based on an increasing rate of an engine speed obtained during a present engine start.

* * * * *